United States Patent [19]

Loughlin et al.

[11] Patent Number: 4,835,996

[45] Date of Patent: Jun. 6, 1989

[54] TAPERED SHACKLE PADLOCK

[76] Inventors: Robert W. Loughlin, 1261 Rahway Rd., Scotch Plains, N.J. 07076; Thomas G. Loughlin, 400 Cold Springs Rd., Apt. D414, Rocky Hill, Conn. 06067

[21] Appl. No.: 180,394

[22] Filed: Apr. 12, 1988

Related U.S. Application Data

[63] Continuation of Ser. No. 000,205, Jan. 2, 1987, abandoned, which is a continuation of Ser. No. 673,181, Nov. 19, 1984, abandoned.

[51] Int. Cl.[4] ..... E05B 67/06

[52] U.S. Cl. ..... 70/53; 70/417; 70/54

[58] Field of Search ..... 70/32, 33, 34, 54, 55, 70/56, 417, 53

[56] References Cited

U.S. PATENT DOCUMENTS

| | | | |
|---|---|---|---|
| 2,848 | 11/1842 | Roper | 70/53 |
| 1,008,979 | 11/1911 | Mews | 70/53 |
| 1,863,503 | 6/1932 | Schlitz | 70/53 |
| 2,079,578 | 5/1937 | Schlesinger | 70/53 |
| 2,407,406 | 9/1946 | Dutton | 70/53 |

*Primary Examiner*—Robert L. Wolfe

*Attorney, Agent, or Firm*—Lerner, David, Littenberg, Krumholz & Mentlik

[57] ABSTRACT

A lateral extension of a shackle end and a lock body securely engage a hasp therebetween. Broadening the shackle end or tapering the shackle provides lateral extension. A shroud or encasement around the hasp, shackle and lock body provides additional security. A sliding shroud with attached shackle fits over the lock body encasement. Alternately, an extension of the lock body encasement itself serves as a shroud with a removable shackle, or a swing plate covers the hasp. Pivoting or rotating arms may secure the shackle to the lock body. Close contact with the hasp and encasement protects against tampering.

23 Claims, 2 Drawing Sheets

TAPERED SHACKLE PADLOCK

This is a continuation of application Ser. No. 000,205, filed Jan. 2, 1987, now abandoned which is a continuation of Ser. No. 673,181, filed on Nov. 19, 1984, now abandoned.

TECHNICAL FIELD

The invention relates to a security padlock and more particularly to an expanded end or shackle inserted through a hasp and removably engaging a locking bolt, wherein the padlock may be enshrouded.

BACKGROUND ART

Conventional padlocks cooperating with an associated hasp to secure doors, equipment, storage spaces, etc., have proven unsatisfactory in preventing unauthorized access to the enclosed area and in securing equipment. The designs of prior art padlocks lend themselves to being defeated by cutting and prying tools. Even when used in cooperation with conventional shields, shrouds, and/or enclosures, the prior art padlock has not been seen to thwart a determined thief's successful access to the supposedly secured space. Padlocks generally fit very loosely within a hasp affording easy insertion of prying or cutting tools to break the lock. The loose fit also fails to keep the closure itself closed tightly when the lock serves also to latch the closure.

Most padlocks have a double post shackle requiring a complex locking bolt mechanism with two openings to receive the shackle. The normally "U" shaped shackle attached to the locking bolt limits the application of the normal padlock in terms of accessibility to the hasp.

Most prior art shielded padlocks are limited in their application because the shield utilized must be permanently mounted to the structure to be secured as a result of either its massive shape or inherent limitations in its deign, thereby inhibiting both the transferability and use of the shield in other locations.

Those prior art shielded lock assemblies which are not permanently fixed to a wall or door are generally comprised of a modified piece added to an existing conventional lock for use with a specifically identifiable hasp, and are generally incapable of cooperating with other existing conventional hasps of differing sizes and shapes.

Constructing prior art shields out of high strength alloy steels and other special materials in order to impair the effectiveness of conventional cutting and prying tools has considerably increased the cost of prior art shielded locks while generally doing little to prevent the undesired unauthorized access.

Prior art shielded locks generally fail to provide any additional means for improving the locking engagement between the padlock and the hasp except for simply enclosing the lock and hasp itself.

DISCLOSURE OF THE INVENTION

The primary object of the present invention is to provide a broad end or tapered single shackle padlock for securely engaging a hasp or other securing device so that the shackle fills any compatible opening in a hasp or other securing device with a secure tight fit.

Sandwiching the hasp tightly between the broad portion of the shackle and the locking bolt provides little or no spaced between the padlock and the hasp, and the present lock is substantially impermeable by cutting or prying tools.

The tapered or broad ended shackle draws tightly across the components being locked serving not only to lock but also secure tightly the components. A shroud surrounding the shackle and hasp further insures a tamper-resistant padlock which is compatible with a variety of hasps.

Providing a broad-ended or tapered single shackle simplifies the padlock mechanism requiring a receiving locking bolt with a single opening.

A single shackle separable from the locking bolt allows a broad range of applications of the present padlock to a variety of different hasps and locking brackets in a variety of locations. The self-securing taper feature of the present shackle permits a broad range of lock types to utilize the shackle.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
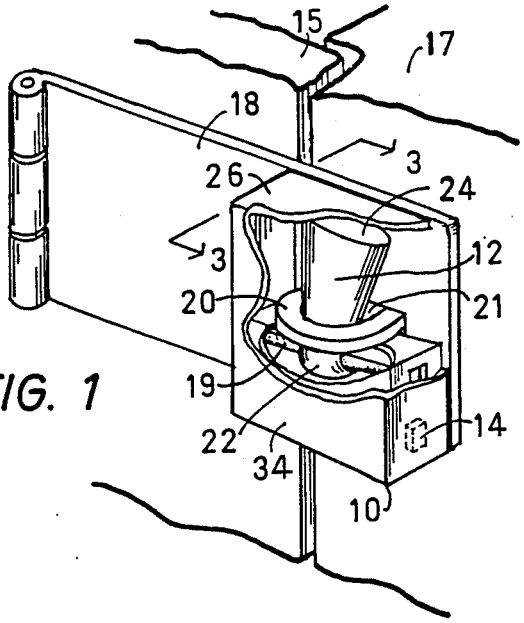
FIG. 1 is a perspective view, in partial section, of the front of the preferred embodiment of the shrouded tapered shackle and locking body in a locked position on a conventional hasp and hinged latch or slotted flap.

In FIG. 1, the preferred embodiment of the invention shows a single shackle padlock 10 including a tapered shackle 12 for removably engaging a lock body 14 having a conventional locking bolt means 19. The shackle 12 and lock body 14 are secured together in locked engagement on a hasp 20 to retain a slotted latch 18 securing in and place acting as a locking closure means between two elements such as a door 15 and associated frame 17.

A shackle comprising a single post 12 is made possible by extending the post laterally at one end 24 to make the post broader than the hasp opening 21 thereby forming a hasp contacting surface on one side of the hasp, while the locking body 14 contacts the hasp 20 on an opposite side to retain the hasp securely therebetween in close contact to prevent any burglar tools from fitting in to pry open the lock or saw through the lock or the hasp. In this embodiment the shackle is tapered from the broad end 24 to the opposite end where a locking bolt engaging means 22 fits within a single means 30 in the lock body 14. Since the shackle shaft 12 is broader than the hasp opening at one end 24 and narrower than the hasp opening at the opposite end 22, the shackle 12 slips easily into the hasp up to the point where the shackle width equals the hasp opening and that point on the shackle shaft serves as the hasp contacting surface. Another means of creating a hasp contacting surface on the shackle is to enlarge the end of the shackle, such as the broad end cap 86 on the plug shackle 80 of FIG. 4.

Figure 2:
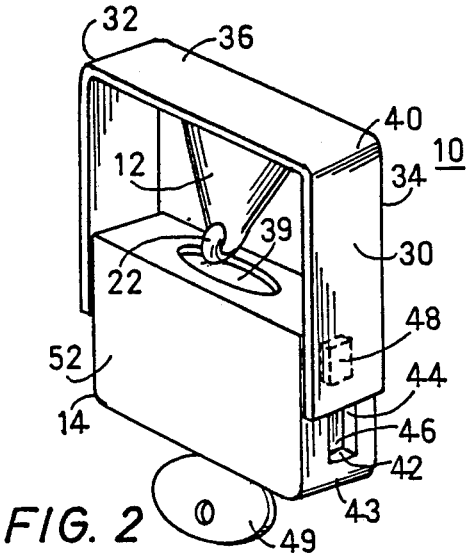
FIG. 2 is a perspective view of the back of the preferred embodiment of the invention.
Figure 4:
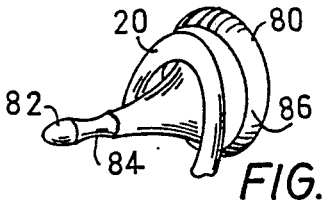
FIG. 4 is a perspective view of a tapered plug shackle circular in cross-section through a U-shaped hasp with a semi-circular opening.
Figure 6:
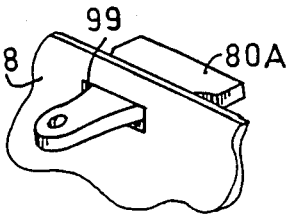
FIG. 6 is a perspective view of a blade shackle, of rectangular cross-section through a special plate hasp having a matching rectangular slot.

A tight fit for safety in a tapered shackle is insured by using a tapered shackle having the same cross-sectional shape as the hasp opening such as the elliptical shackle and hasp seen in FIGS. 1 and 2, circular in FIG. 4 or rectangular in FIG. 6 showing a tapered blade shackle 80A fitting within a special hasp 98 having a matching rectangular opening 99. Other shapes are also possible. The tight fitting shackle may serve as a tight closure means in addition to a locking means when no other latching means are used on a closure.

Figure 5:
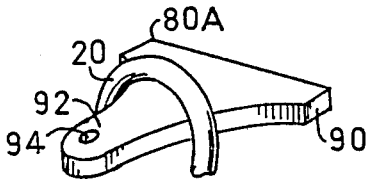
FIG. 5 is a perspective view of a blade shackle through a standard U-shaped hasp.
Figure 9:
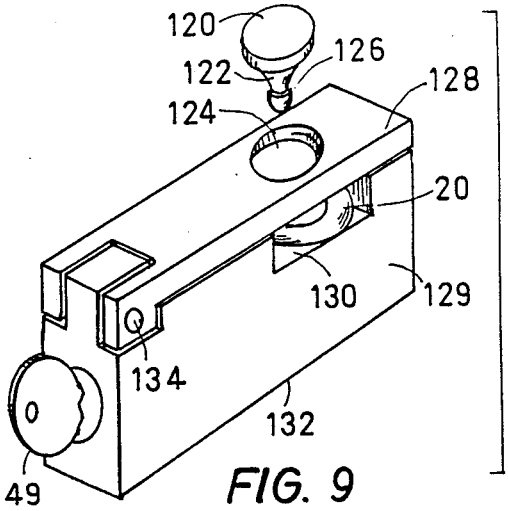
FIG. 9 is a perspective view of an alternate embodiment of the invention showing a tapered capped shackle aligned for insertion in a locking body having a hinged pivoting cover plate.

The locking bolt engaging means 22 of FIGS. 1 and 2 comprises at the tapered end of the shackle a hook 22 which is engaged and locked in place by a movable shaft 19 or other conventional locking bolt means. Other locking bolt engaging means at the end of the shackle shaft include an enlarged tip 108 in FIG. 7, a groove 84 in FIG. 4, a groove 122 and enlarged tip 126 in FIG. 9, an opening 94 through the end as in the blade shackle 90 of FIGS. 5 and 6, through which opening 94 the locking bolt would slide. Other means are also possible.

The shackle 12 should be fabricated of hardened steel to prevent cutting and may be coated with Teflon TM or other lubricating surface to facilitate retraction of the shackle from the hasp and lock body, as well as to minimize wear and damage to all of the components.

Further assurance of a tamper-proof padlock is had by providing an enclosure or shroud around the locking bolt, shackle and hasp as in FIGS. 1–3, 7, 9 and 10. In FIG. 1, the shackle 12 is welded or cold formed (staked) along the cross-sectional face of its broad end 24 to rectangular shaped shroud 26 at a locus such that sliding the shroud 26 in downward vertical axial movement will result in the removably engaged end 22 entering, and cooperating, with the conventional locking engagement means 19 of conventional lock body 14.

Shown in FIG. 2 is a rear elevational view of the preferred embodiment of the shrouded tapered shackle lock 10 of FIG. 1. Shroud 26 includes a pair of side walls 30, 22 an outer wall 34 and an upper wall 36, joined in such a combination to form a rectangular solid shaped enclosure congruous to, but of slightly wider and lengthier external dimensions, than the conventional lock body 14. The designed variance in dimensions enables the shroud 26 to slide unimpeded over the conventional lock body 14, while at the same time allowing shroud 26 to maintain a sufficiently tight proximity to the lock body 15 face so as to prevent the insertion of a file, crowbar, or other tampering tool. In an alternative embodiment, a square, diamond, elliptical or circular shroud configuration, which is congruous to the alternative lock body embodiment, may be utilizied. In the preferred embodiment the shroud wall junctions 40 are also rounded to minimize tampering through the application of gripping and leverage tools.

Rectangular shaped groove 42 extends vertically along the cross-section of both conventional lock body sides 43, in parallel to the side walls 30, 32. Groove 42 includes interior groove faces 44 and interior groove junctions 46 which in the preferred embodiment are slightly rounded to facilitate sliding of cooperating sliding protrusion or strut 48, which extends inward from each side wall 30, 32 into the respective groove 42. Cooperating sliding strut 48 may be beveled so that its surface is rounded inversely to that of interior groove face 44, so that the strut 48 appears half cylindrical in this embodiment, to optimize further the sliding capability. The struts and grooves could be reversed in location. Turning key 49 disengages the locking engagement of conventional lock body 14 and releases the removably engaged end 22 of the shackle. This enables the shroud 26 to slide upward in vertical axial direction by means of cooperating sliding strut 48 and vertical grooves 42, so that hasp 20 removably receives the tapered shackle 12 thereby unlocking the hasp components 18 and 20 and allowing access to the previously enclosed area.

Figure 3:
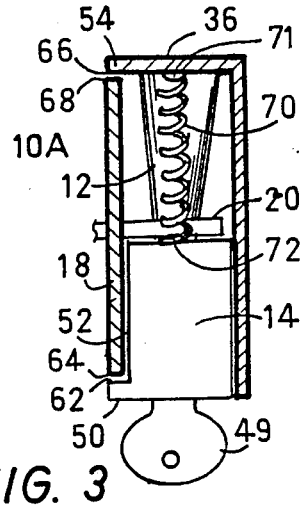
FIG. 3 is a sectional view of an alternate embodiment of the invention taken through 3—3 of FIG. 1, showing projecting skirts and spring means for retaining the associated shackle and locking components together.

FIG. 3 is an elevational section view taken through line 3—3 of FIG. 1 of an alternative embodiment of a shrouded tapered shackle lock 10A which provides additional means for securely retaining together, and protecting, the associated locking mechanism and shackle components. In this embodiment a first rectangular skirt 50 projects outwardly from the lower rear face 52 of conventional lock body 14, and a second rectangular skirt 54 projects outwardly from the rear face of upper wall 36. Turning key 49 releases the removably engaged end 22 of the tapered shackle 12, enabling the shroud 26 to slide upwardly. With the shroud 26 extending to its upper limitation, the upper face 62 of the skirt 50 is projected underneath the lower boundary 6 of the latch 18, while the lower face 66 of skirt 54 is positioned directly above, and overlaying, the upper boundary 68 of the latch 18. Sliding the shroud 26 downwardly allows the removably engaged end 22 to engage the conventional locking means of the conventional lock body 14, while also enabling skirts 50, 54 to become aligned adjacent to, and flush with, upper and lower boundaries 64, 68, thereby additionally retaining the tapered shackle lock 10A to the hasp components 18 and 20. Utilization of skirts 50 and 54 will seriously impair any tampering through application of twisting and turning tools, and will also prevent insertion of a crowbar or file between the lock body rear face 52 and the adjacent hasp components 18 and 20.

Compression springs 70 are each fixed to the interior upper face 71 of the shroud and to the upper lock body face 72 in order to facilitate retraction of the tapered shackle opposite end 24 and the hasp 20 upon locking disengagement of removably engaged end 22. In this embodiment the springs 70 are fixed along the plane intersecting the center line of the tapered shackle 12 which is perpendicular to the side walls 30, 32, at a locus closer to the side walls 30, 32 than to the tapered shackle 12 so not to interfere with the operation of the hasp 20. Compressive forces work in direct opposition to the associated restraining forces of the tapered shackle lock 10A, so that the springs 70 are limited in their strength to have no appreciable adverse effect upon the overall locking capability.

Figure 7:
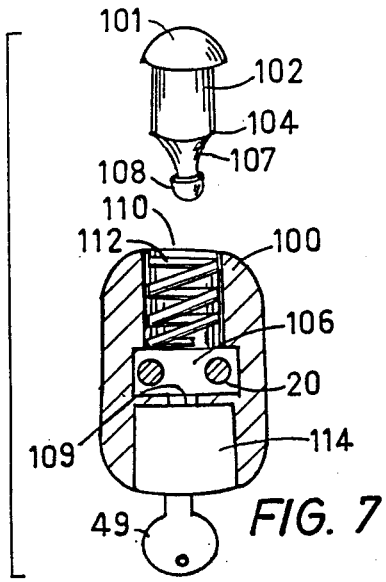
FIG. 7 is a cross-sectional view of an alternate embodiment of a plug shackle and one-piece shrouded locking body.
Figure 8:
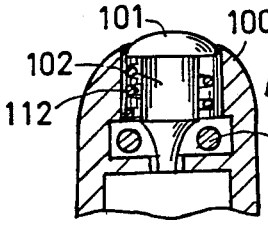
FIG. 8 is a partial cross-sectional view of the alternate embodiment of FIG. 7, now shown with the shackle fully inserted in the lock body.
Figure 10:
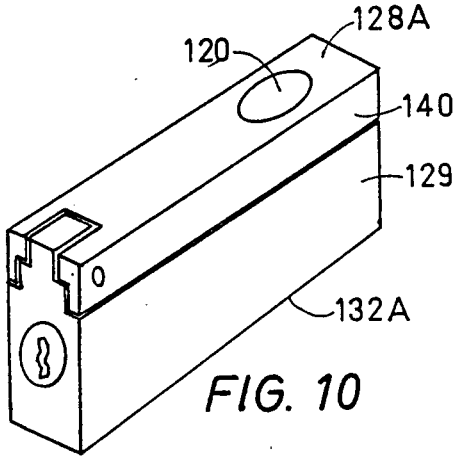
FIG. 10 is a perspective view of an alternate embodiment of the hinged pivoting cover plate further provided with a side shield covering the end of the hasp and a shackle permanently secured to the cover plate.

In FIG. 7, an alternate embodiment provides a lock body 100 having an extension of the locking bolt casement which serves as its own stationary shroud or enclosure covering the removable plug shackle 102, the hasp 20 and the standard locking bolt 114 when in locked engagement. A transverse opening 106 admits the hasp 20 therein. Circular in cross-section, the plug shackle 102 is inserted into the single recess 110 in the shrouded lock body to compress a spring 112. The enlarged tip 108 on the tapered tip 107 of the shackle is inserted in a locking bolt opening 109 to be received in locked engagement by a conventional locking bolt 114 operated by a key 49 or other conventional means, such as combination or magnetic locking means. When the plug shackle 102 is fully inserted in the locked position, as in FIG. 8, the domed top 101 of the shackle aligns with the shape of the outer enclosure of the lock body 101 to form a substantially smooth surface thereby preventing the insertion of burglar tools. The spring 112 forces the shackle 102 from the lock body 100 upon release of the lock mechanism In FIG. 9, a swing arm embodiment of the invention comprises a lock body 132 having an elongated lock bolt encasement 129 with a notched recess 130 in an upper face to receive a hasp 20. A swing arm 128 is pivotally attached to the lock body by a hinge 134. In the locked position the swing arm 128 covers the hasp 20. An opening 124 in the swing arm admits a tapered shackle 120 to be inserted through the hasp and lock into a conventional locking bolt operated by a key 49 or other conventional means. The shackle 120 may be separable from the plate as in FIG. 9 (necessary for a fixed arm) or permanently attached to the swing arm by welding, staking or other means, as in FIG. 10, wherein an alternate swing arm 128A is shown with a lateral extension 140 downwardly on one side to cover the hasp for further security.

Figure 12:
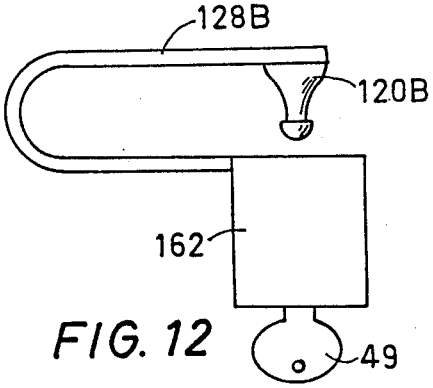
FIG. 12 is an elevated view of an alternate swing plug embodiment having a tensioned swing plate or swing pin with a plug shackle.

Another embodiment of the swing arm lock in FIG. 12 shows a lock body 162 having a securely connected spring arm or plate 128B with the attached shackle 120b. The long spring arm 128B freely swings to insert the shackle 120B into the lock body 16 to fit snugly with the arm serving as a hasp.

Figure 11:
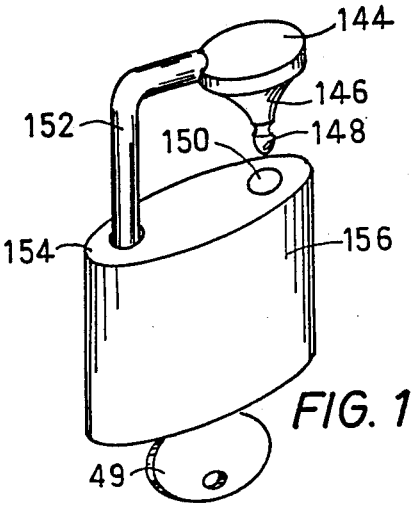
FIG. 11 is a perspective view of an alternate embodiment of the invention with a pivoting post permanently connecting the shackle to a padlock-type locking body.

An alternate pivoting post embodiment 154 of the invention, in FIG. 11, shows a rotatable arm 152 with attached plug shackle 144 for insertion into a recess 150 in a conventional padlock lock body 156 with a conventional locking bolt operated by a key 49 or other conventional means. The arm 152 slides and rotates within the lock body.

It is understood that the preceding description is given merely by way of illustration and not in limitation of the invention and that various modifications may be made thereto without departing from the spirit of the invention as claimed.

I claim:

1. In combination:

a hasp device having a hasp opening therethrough of a predetermined lateral dimension;

a shackle padlock for being secured to said hasp device, said shackle padlock comprising (a) an elongated shackle member having a tapered section, said tapered section including a first end and a second end, said first end of said tapered section having a lateral dimension less than said predetermined lateral dimension of said hasp opening and said second end of said tapered section having a lateral dimension greater than said predetermined lateral dimension of said hasp opening, said tapered section gradually increasing in lateral dimension from said first end to said second end of said tapered section, and (b) a lock body having a shackle recess therein and having releasable engagement means for releasably engaging said shackle member when said first end of said tapered section is inserted into said shackle recess; and said hasp device and said shackle padlock being arrangeable in locked engagement so that said hasp device is sandwiched between said lock body and a hasp contact surface of said tapered section of said shackle member when said first end of said tapered section is passed through said hasp opening and inserted into said shackle recess and said shackle member is engaged by said releasable engagement means.

2. The combination of claim 1, wherein said elongated shackle member includes a lockable end and wherein said releasable engagement means is operative to releasably engage said lockable end of said shackle member when said first end of said tapered section is inserted into said shackle recess.

3. The combination of claim 2, wherein said elongated shackle member has a lateral dimension less than said predetermined lateral dimension of said hasp opening; wherein said tapered section is oriented relative to said lockable end so that said first end of said tapered section is between said lockable end of said shackle member and said second end of said tapered section; and wherein said releasable engagement means is positioned within said lock body for releasably engaging said lockable end of said shackle member when said lockable end and said first end of said tapered section are inserted into said shackle recess.

4. The combination of claim 1, wherein said hasp contact surface of said tapered section comprises the portion of said tapered section which has a lateral dimension equal to said predetermined lateral dimension of said hasp opening.

5. The combination of claim 1, wherein the cross sectional shape of said tapered section of said shackle member corresponds to a portion of the shape of said hasp opening.

6. The combination of claim 5, wherein at least said portion of said shape of said hasp opening is curved and wherein said tapered section includes a corresponding curved cross sectional shape for mating contact with said curved shape of said hasp opening.

7. The combination of claim 1, further including enclosure means for enclosing said shackle member when said hasp device and said shackle padlock are arranged in locked engagement.

8. The combination of claim 7, wherein said enclosure means further encloses at least the sandwiched portion of said hasp device and the portion of said lock body having said shackle recess therein when said hasp device and said shackle padlock are arranged in locked engagement.

9. The combination of claim 8, wherein said enclosure means comprises a sheath affixed to one of said lock body and said shackle member, said sheath encompassing said shackle member and the portion of said lock body having said shackle recess therein when said hasp device and said shackle padlock are arranged in locked combination.

10. The combination of claim 9, wherein said sheath is affixed to said shackle member.

11. The combination of claim 10, further including means for mounting said sheath for sliding movement on said lock body so as to permit relative movement between said sheath and said lock body along a direction parallel to an imaginary line extending between said first and second ends of said tapered section.

12. The combination of claim 11, wherein said means for mounting said sheath for sliding movement comprises at least one slot in one of said lock body and said sheath, and at least one protrusion on the other of said lock body and said sheath for being received in and cooperating with said at least one slot.

13. The combination of claim 12, wherein said at least one slot is provided in said lock body and said at least one protrusion is provided on said sheath.

14. The combination of claim 5, wherein said shackle member is flat and has a rectangular cross section, and wherein the shape of said hasp opening is rectangular.

15. The combination of claim 5, wherein the shape of said portion of said hasp opening is semi-circular.

16. The combination of claim 5, wherein said hasp opening comprises an elongated slot having a length corresponding to said predetermined lateral dimension and wherein said shackle member is flat and has a thickness corresponding to the width of said elongated slot.

17. The combination of claim 8, wherein said hasp device further includes a staple having said hasp opening therein, and a plate member having a pair of spaced edges and a staple opening through which said staple is adapted to extend laterally between said pair of spaced edges; and wherein said lock body includes a laterally extending protrusion and said sheath includes a laterally extending protrusion, said protrusions of said sheath and said lock body being adapted to overlie said pair of spaced edges of said plate member when said hasp device and said shackle padlock are arranged in locked engagement.

18. The combination of claim 17, further including compression spring means arranged between said sheath and said lock body for urging said shackle member and said lock body apart from one another when said hasp device and said shackle padlock are not in locked engagement.

19. The combination of claim 8, wherein said lock body includes a hasp receiving recess surrounding said shackle recess, and wherein said enclosure means comprises a cover member adapted to cover said hasp receiving recess.

20. The combination of claim 19, wherein said cover member is hinged to said lock body.

21. The combination of claim 1, wherein said lock body further includes a pivoting arm and wherein said shackle member is fixed to said pivoting arm.

22. The combination of claim 1, wherein said lock body includes a flexible arm affixed to said lock body and wherein said shackle member is attached to said flexible arm.

23. The combination of claim 1, wherein said shackle member is separable from said lock body.

* * * * *

UNITED STATES PATENT AND TRADEMARK OFFICE

CERTIFICATE OF CORRECTION

PATENT NO. : 4,835,996

DATED : June 6, 1989

INVENTOR(S) : Loughlin et al.

It is certified that error appears in the above-identified patent and that said Letters Patent is hereby corrected as shown below:

Column 2, line 1, delete "impermeable" and insert therefor --impenetrable--.

Column 3, line 4, "and place" should read --place and--;
line 17, delete "means 30" and insert therefor --recess 39--;
line 66, "22" should read --32--.

Column 4, line 50, "6" should read --64--.

Column 5, line 53, "16" should read --162--.

Column 6, line 57, delete "said" (first occurrence) and insert therefor --the--.

Column 7, line 10, delete "combination" and insert therefor --engagement--.

Column 8, line 36, "separable" should read --separate--.

Signed and Sealed this

Twenty-seventh Day of February, 1990

*Attest:*

JEFFREY M. SAMUELS

*Attesting Officer*

*Acting Commissioner of Patents and Trademarks*